US007317470B2

(12) United States Patent
Seibert

(10) Patent No.: US 7,317,470 B2
(45) Date of Patent: Jan. 8, 2008

(54) IMAGING DEVICE FOR A PRINTING FORM AND METHOD FOR ARRANGING OPTICAL COMPONENTS IN THE IMAGING DEVICE

(75) Inventor: Claus Seibert, Leimen (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 305 days.

(21) Appl. No.: 10/864,223

(22) Filed: Jun. 9, 2004

(65) Prior Publication Data

US 2004/0252181 A1 Dec. 16, 2004

(30) Foreign Application Priority Data

Jun. 16, 2003 (DE) ..... 103 26 923

(51) Int. Cl.
*B41J 27/00* (2006.01)
*B41J 15/14* (2006.01)

(52) U.S. Cl. ..... 347/244; 347/258

(58) Field of Classification Search ..... 347/238, 347/241–244, 256–258, 117, 122, 130, 230; 372/3; 359/648, 198, 455, 618–626, 637
See application file for complete search history.

(56) References Cited

U.S. PATENT DOCUMENTS 4,900,130 A * 2/1990 Haas ..... 359/198
5,619,245 A * 4/1997 Kessler et al. ..... 347/241
5,745,153 A * 4/1998 Kessler et al. ..... 347/241
6,433,934 B1 * 8/2002 Reznichenko et al. ..... 359/622
2002/0005890 A1 1/2002 Beier et al. ..... 347/238
2002/0167584 A1 11/2002 Zelenka ..... 347/234
2003/0026176 A1 2/2003 Albrecht et al. ..... 369/44.14
2003/0058898 A1 * 3/2003 Beier ..... 372/3
2004/0004770 A1 * 1/2004 Ebina et al. ..... 359/648

FOREIGN PATENT DOCUMENTS

DE 199 15 820 A1 10/2000
DE 19915820 10/2000
DE 10031915 1/2002
DE 10122484 11/2002
DE 10124215 11/2002
EP 0641116 3/1995

* cited by examiner

*Primary Examiner*—Hai Pham
(74) *Attorney, Agent, or Firm*—Davidson Davidson & Kappel, LLC

(57) ABSTRACT

An imaging device (10) for a printing form (12), has at least one first and one second laser diode bar (14, 16), the laser diodes (18) on the laser diode bars (14, 16) being disposed in lines. The device includes a first and a second micro-optics (21, 22) for generating aberration-corrected intermediate image spots of the laser diodes (18) and a macro-optical imaging optics (23) for generating image spots (24) on the printing form (12). The first and the second micro-optics (21, 22) are positioned in such a way in the emission regions of the first and second laser diode bar (14, 16) that the image spots (24) of the laser diodes (18) of the first and second laser diode bar (14, 16) lie at disjoint positions on the printing form (12), substantially along a spanning polyline (30). Also, a method is provided for arranging optical components in an imaging device (10) for a printing form (12).

19 Claims, 3 Drawing Sheets

IMAGING DEVICE FOR A PRINTING FORM AND METHOD FOR ARRANGING OPTICAL COMPONENTS IN THE IMAGING DEVICE

This claims the benefit of German Patent Application No. 103 26 923.1, filed Jun. 16, 2003 and hereby incorporated by reference herein.

BACKGROUND INFORMATION

The present invention is directed to an imaging device for a printing form, having at least one first laser diode bar and one second laser diode bar, the laser diodes on the first laser diode bar being disposed in a first line, and the laser diodes on the second laser diode bar being disposed in a second line, including a micro-optical array for generating aberration-corrected intermediate image spots of the laser diodes and a macro-optical imaging optics for generating image spots of the intermediate image spots on the printing form. The present invention is also directed to a method for arranging optical components in an imaging device for a printing form.

To an increasing degree, laser diode bars, which accommodate a number of laser diodes, particularly arranged in one line (linear array), are being used as light sources in imaging devices for printing forms, whether in a printing-form imagesetter or in a print unit of a printing press (direct on-press imaging print unit). An imaging device having such laser diode bars, in particular individually controllable laser diode bars, is described, for example, in U.S. Patent Application No. 2002/0005890 A1. Typically, the laser diode bars have widths on the order of centimeters and preferably accommodate between 30 and 80 emitters or laser diodes. The greater the number of laser diodes (whether integrated on a laser diode bar or distributed over a plurality of laser diode bars), the greater is also a temporal and spatial parallelization of the imaging of a printing form, it also being possible to suitably shorten the total exposure duration necessary for imaging the printing surface of the printing form. At the same time, however, it is essential for the functionality of the imaging device, particularly when an interleave imaging method is used in accordance with U.S. Patent Application 2002/0005890 A1, that all emitters on the laser diode bar be intact and also remain so for a longest possible service period. As the number of laser diodes on a laser diode bar goes up, the probability increases that a laser diode on a laser diode bar has failed or will fail. For that reason, a large number of laser diodes on a laser diode bar is disadvantageously associated with the danger of a rapid loss of operability.

At the same time, when assembling or mounting a laser diode bar in an imaging device, one encounters a particular difficulty that has implications for the imaging process: Although very stringent demands are placed on the positional tolerances of the emitters in the manufacturing of the laser diode bar, in particular to facilitate an interleave imaging process, this positional precision can be lost again during assembly. Unequal thermal expansion coefficients of the laser diode bar and of a holding element, such as a heat sink element, can cause the laser diode bar to become deformed during soldering. Frequently, the result of such a deformation is a tilted, distorted, or even curved characteristic of the line of laser diodes, which is, therefore, also referred to as a smile effect. The deviation in the emitter actual position from the emitter setpoint position, caused by the deformation, is often made even worse by a micro-optical array or micro-optics, i.e., by an array of optical elements which is assigned to the laser diode bar and in which individual optical elements (although sometimes also integrated in one component) only function in response to individual laser diodes. The larger the laser diode bar is, the greater is also the difference in expansion and/or difference in contraction induced by the temperature variation. For that reason, when a large laser diode bar is used, there is the inherent risk of a pronounced smile effect resulting from the assembly operation.

From the European Patent Application No. EP 0 641 116 A1, it is known that a micro-optical array in an imaging device can include individual microlenses, in each instance, one microlens being assigned to one laser diode bar on a laser diode bar. The microlenses have a common image plane. A macro-optical array, i.e., an array of optical elements, which acts simultaneously in response to the light from all laser diodes, projects the light emitted by the laser diode bars from the image plane onto a plane in which a photoreceptor is located. The optical axes of the microlenses coincide in each case with the optical axes of the laser diodes. For that reason, no correction is made in response to a possible deviation in the laser diodes' actual position from a setpoint position.

One possible way to compensate for the smile effect of a laser diode bar during imaging is described, for example, in U.S. Patent Application No. 2003/0026176 A1. A two-dimensional printing form surface is scanned by light beams from an imaging device having a number of laser diodes on a laser diode bar, rapidly in a first direction, and slowly in a second direction that is linearly independent, in particular orthogonal to the first direction. When, in response to simultaneous triggering, the image spots of the light beams do not lie on a desired curve, in particular straight line, printing dots can be produced on a projection line by the action of the light energy on the printing form surface in that the individual laser diodes are triggered with a time delay in such a way that one of the laser diodes emits light at the very moment when its image spot sweeps over the projection line. It is clear that this projection does, in fact, lead to an array of printing dots on the projection line, however there is no possible way to correct positional deviations in the direction orthogonal to the first direction in which a fast scanning takes place.

BRIEF SUMMARY OF THE INVENTION

An object of the present invention is to devise an imaging device which will make it possible to reduce the deformation effects of a laser diode bar.

An imaging device according to the present invention for a printing form has at least one first laser diode bar and one second laser diode bar, a micro-optical array for generating aberration-corrected intermediate image spots of the laser diodes (preferably virtual intermediate image spots), and a macro-optical imaging optics for generating image spots of the intermediate image spots on the printing form. The laser diodes on the first laser diode bar are disposed in a first line (linear array), and the laser diodes on the second laser diode bar are disposed in a second line (linear array). The micro-optical array includes at least one first micro-optics and one second micro-optics. The first micro-optics is positioned in such a way in the emission region of the first laser diode bar, and the second micro-optics in the emission region of the second laser diode bar, that the image spots of the laser diodes of the first and of the second laser diode bar lie at disjoint positions on the printing form, along a spanning polyline. Thus, the image spots do not coincide or overlap.

The spanning polyline is representable as a function of a variable of a spanning direction of the printing form.

In particular, the printing form may be accommodated on a cylinder, be part of a cylinder jacket, or itself constitute a cylinder jacket. The spanning polyline is, in particular, unfolded or lies extended on the surface of the printing form. In other words, the angles among individual adjacent line segments are, in particular, obtuse angles. The spanning direction may be, in particular, the slow scanning direction in an interleave imaging process. The laser diodes may emit light, in particular, in the infrared or visible spectral region. Besides refractive optical components, the macro-optical imaging optics may also encompass reflective optical components.

The positioning errors of the laser diode bars relative to each other are advantageously compensated by the adjusted micro-optical array having a plurality of micro-optics. Permissible positioning tolerances of the emitters or laser diodes may be advantageously achieved: In the imaging device according to the present invention, the image spots of the laser diodes lie within positioning tolerances in a way that enables an interleave imaging process to be carried out as if one single large laser diode bar were present having a number of laser diodes equal to the sum of the number of laser diodes of the first laser diode bar and the number of laser diodes of the second laser diode bar. The number of laser diodes on the first and second laser diode bar may be, but does not necessarily have to be identical. In short, in the imaging device according to the present invention, the action of one large laser diode bar is provided by the action of two small laser diode bars. Small laser diode bars, i.e., laser diode bars having a small number of laser diodes, are less expensive and simpler to manufacture than large laser diode bars, i.e., laser diode bars having a large number, that is greater than the small number, of laser diodes, since, inter alia, functional laser diode bars are more efficient. One advantageous interleave imaging method is described in German Patent Application No. DE 100 31 915 A1 and in U.S. Application No. 2002/0005890 A1. These documents are hereby incorporated herein by reference.

The first line of the laser diodes on the first laser diode bar and the second line of the laser diodes on the second laser diode bar may lie essentially in one straight line. In addition or alternatively thereto, the first laser diode bar and the second laser diode bar may be accommodated on one heat sink element.

In the imaging device according to the present invention, the image spots may lie on one spanning polyline, composed of sectionally straight lines. The image spots of the laser diodes of the first laser diode bar lie in a first straight line, and the image spots of the laser diodes of the second laser diode bar lie in a second straight line. It is especially beneficial, particularly for an interleave imaging process, when the spanning polyline is a straight line. In particular, the spanning direction, especially the slow scanning direction in an interleave imaging process, may be the direction of the straight line of the spanning polyline.

In the imaging device according to the present invention, the laser diodes may be individually controllable. Each laser diode may be assigned to an imaging channel. A control unit may also be provided in the imaging device to render possible a time-delayed triggering of individual laser diodes. Such a time-delayed triggering is described in German Patent Application No. DE 101 24 215 A1 and in U.S. Patent Application No. 2003/0026176 A1. These documents are hereby incorporated herein by reference.

It is particularly advantageous in one preferred specific embodiment of the imaging device that the first micro-optics and the second micro-optics are each composed of at least two optical elements. In this context, one of the elements has a refractive action in the sagittal direction on light emitted by the associated laser diode bar, and the other one of the elements has a refractive action in the meridional direction on light emitted by the associated laser diode bar. In particular, the elements have different refractive powers. This makes it possible to advantageously correct the emission characteristics of the laser diodes that are not rotationally symmetric about the axis of propagation.

In one advantageous specific embodiment, the imaging device is suited for implementing an interleave imaging method, as described in particular, in German Patent Application No. DE 100 31 915 A1 and in U.S. Patent Application No. 2002/0005890 A1, which are incorporated in this description. In this context, the spatial interval between adjacent image spots on the printing form, measured in units of the pitch distance of the printing dots, may be an integral multiple of the pitch distance of the printing dots, greater than one. The integral multiple is preferably prime to the number of image spots. This is particularly the case when the integral multiple and the number of image spots are prime numbers which are both different from one.

In one advantageous further refinement, in the imaging device according to the present invention, at least one further laser diode bar is provided, in whose emission region, one further micro-optics is positioned in such a way that the image spots of the laser diodes of the additional laser diode bar, also lie at disjoint positions on the printing form, along a continuation of the spanning polyline, the spanning polyline, including the continuation, being representable as a function of a variable of a spanning direction of the printing form. In other words, an imaging device according to the present invention may have a plurality of laser diode bars which are positioned in accordance with the present invention. In addition or alternatively thereto, an imaging device according to the present invention may also include a number of imaging modules, in which a plurality, in particular two laser diode bars, are grouped. An imaging device may typically have three or four imaging modules.

The imaging device according to the present invention may be used quite advantageously in a printing-form imagesetter or in a print unit, described, in particular, as a direct on-press imaging print unit. A printing-form imagesetter according to the present invention includes at least one imaging device according to the present invention. A print unit according to the present invention includes at least one imaging device according to the present invention.

The print unit according to the present invention may be a direct or indirect offset print unit (normal or waterless offset printing method), a flexographic print unit, a gravure print unit, or the like. The print unit may be part of a printing press. In other words, a printing press according to the present invention includes at least one print unit according to the present invention. The printing press may be a sheet-processing or a web-processing press. A sheet-processing printing press may have a feeder, at least one print unit (typically, four, six or eight), optionally a surface-finishing unit (punching unit, varnishing system or the like), a dryer, and a delivery unit. A web-processing printing press may include an automatic reexchange, at least one printing cylinder tower (typically four, six or eight), one printing tower having at least two print units for printing on both sides of the web, one dryer, and one folder. Typical printing substrates include paper, cardboard, carton, organic polymer sheeting or fabric, or the like.

Also provided in the context of the inventive idea is a method for configuring laser light sources of an imaging device for a printing form. This method encompasses at least the following steps: A first laser diode bar is mounted on, secured to or positioned on a holding element, in particular a heat sink element. In particular, the laser diode bar is soldered, an indium foil being used as an intermediate layer. A first micro-optics is positioned in the emission region of the first laser diode bar. The first micro-optics may, in particular, be centrally mounted in front of the first laser diode bar. A second laser diode bar is then mounted on the holding element, in particular the heat sink element. When the second laser diode bar is mounted, positioning tolerances, on the order of a few micrometers, occur relative to the first laser diode bar. A second micro-optics is positioned in such a way in the emission region of the second laser diode bar, that the image spots of the laser diodes of the first and of the second laser diode bar lie at disjoint positions, along a spanning polyline, which is representable as a function of a variable of a spanning direction of the printing form. In other words, the second micro-optics is mounted in a way that compensates for the mounting tolerances of the second laser diode bar, so that the image spots of the laser diodes are situated at desired positions, in particular at positions that would be occupied by image spots of one single large laser diode bar having a number of laser diodes equal to the sum of the number of laser diodes of the first laser diode bar and the number of laser diodes of the second laser diode bar.

In other words, the positioning tolerances that result when mounting a plurality of laser diode bars on one heat sink element are compensated by the use of a divided micro-optical arrangement having a plurality of micro-optics, and by properly adjusting the same.

In a preferred embodiment of the method according to the present invention, the laser diode bars are mounted side-by-side in such a way that the laser diodes of the first laser diode bar and the laser diodes of the second laser diode bar lie in one line. In addition or alternatively thereto, the positional tolerance of the second laser diode may be compensated by adjusting the second micro-optics.

In one advantageous further refinement of the method according to the present invention, the described procedure for the second laser diode bar is iterated or repeated for a number of further laser diode bars and further micro-optics, if the intention is for further laser diode bars to be grouped in an imaging module or in the imaging device.

The first and the second, and optionally further micro-optics may also be accommodated or mounted on the heat sink element.

BRIEF DESCRIPTION OF THE DRAWINGS

Further advantages, advantageous embodiments and refinements of the present invention are described on the basis of the following figures, as well as their descriptions, each of which show.

DETAILED DESCRIPTION

Figure 1:
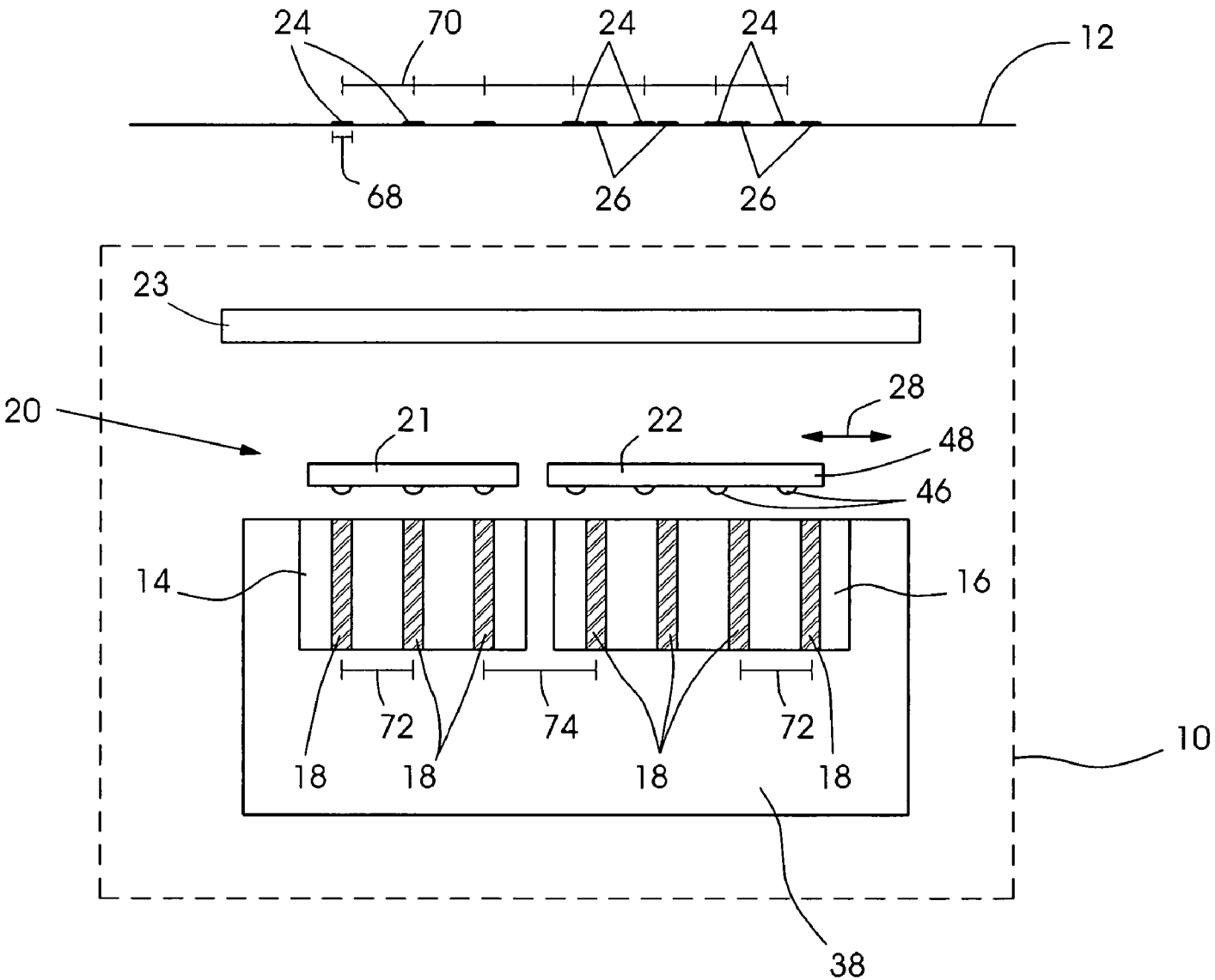
FIG. 1 a schematic plan view of one specific embodiment of an imaging device according to the present invention having a first and a second laser diode bar.

FIG. 1 shows a schematic plan view of one specific embodiment of an imaging device according to the present invention having a first and a second laser diode bar. Imaging device 10 is used to produce printing dots on a printing form 12. Imaging device 10 has a first laser diode bar 14 and a second laser diode bar 16. Laser diode bars 14, 16 are accommodated side-by-side, i.e., in such a way on a heat sink element 38, that laser diodes 18 arranged in a row or line, in this case three on first laser diode bar 14 and four on second laser diode bar 16, lie in a straight line. Downstream from laser diode bars 14, 16 is a micro-optical array 20 of optical components: A first micro-optics 21 is situated in the emission region of laser diodes 18 of first laser diode bar 14, and a second micro-optics 22 is positioned in the emission region of the laser diodes of second laser diode bar 16. In the specific embodiment shown in FIG. 1, a micro-optics 21, 22 for each laser diode 18 includes a sagittal micro-optical element 46 and a meridional micro-optical element 48, which are integrated in one optical component. The light emitted by laser diodes 18 subsequently propagates through a macro-optical imaging optics 23, which produces image spots 24, 26 on printing form 12. While adjacent laser diodes 18 have a uniform pitch 72 relative to one another on their laser diode bars 14, 16, spatial interval 74 of laser diode bars 14, 16, defined as the spatial interval of the mutually adjacent laser diodes 18, situated, respectively, on the extremities of laser diode bars 14, 16, generally does not equal pitch 72, but is distinctly larger. Given a centered arrangement of second micro-optics 22 in front of second laser diode bar 16, image spots 26 are formed (position of the image spots prior to adjustment) on printing form 12 in an undesirably too large spatial interval to image spots 24 of laser diodes 18 of first laser diode bar 14. By making an adjustment 28 transversally to the emission direction, i.e., positioning second micro-optics 22 so as to be offset from the optical emission axes of laser diodes 18, it is possible to change the position of image spots 26 of laser diodes 18 of second laser diode bar 16 on printing form 12 in such a way that image spots 24 are formed which lie in a desired spatial interval to image spots 24 of laser diodes 18 of first laser diode bar 14. For an interleave imaging process, image spots 24 should have a regular or uniform spatial interval 70, which is an integral multiple of the pitch distance of the adjacent printing dots, equivalent to printing dot size 68.

It is noted at this point that, in some specific embodiments of imaging device 10 according to the present invention, spatial interval 74 of laser diode bars 14, 16 (spatial interval of the outer, mutually facing laser diodes 18 at the edges of laser diode bars) may be smaller than pitch 72 of laser diodes 18, and that, in other specific embodiments, spatial interval 74 of laser diode bars 14, 16, on the other hand, may be considerably or clearly larger than pitch 72 of laser diodes 18. These embodiments occur frequently, in so far as one or more laser diodes are often not utilized at the edge of a laser diode bar 14, 16. The edge emitters are often left in an out-of-service condition, since they can be damaged in the cleaving process.

Figure 2:
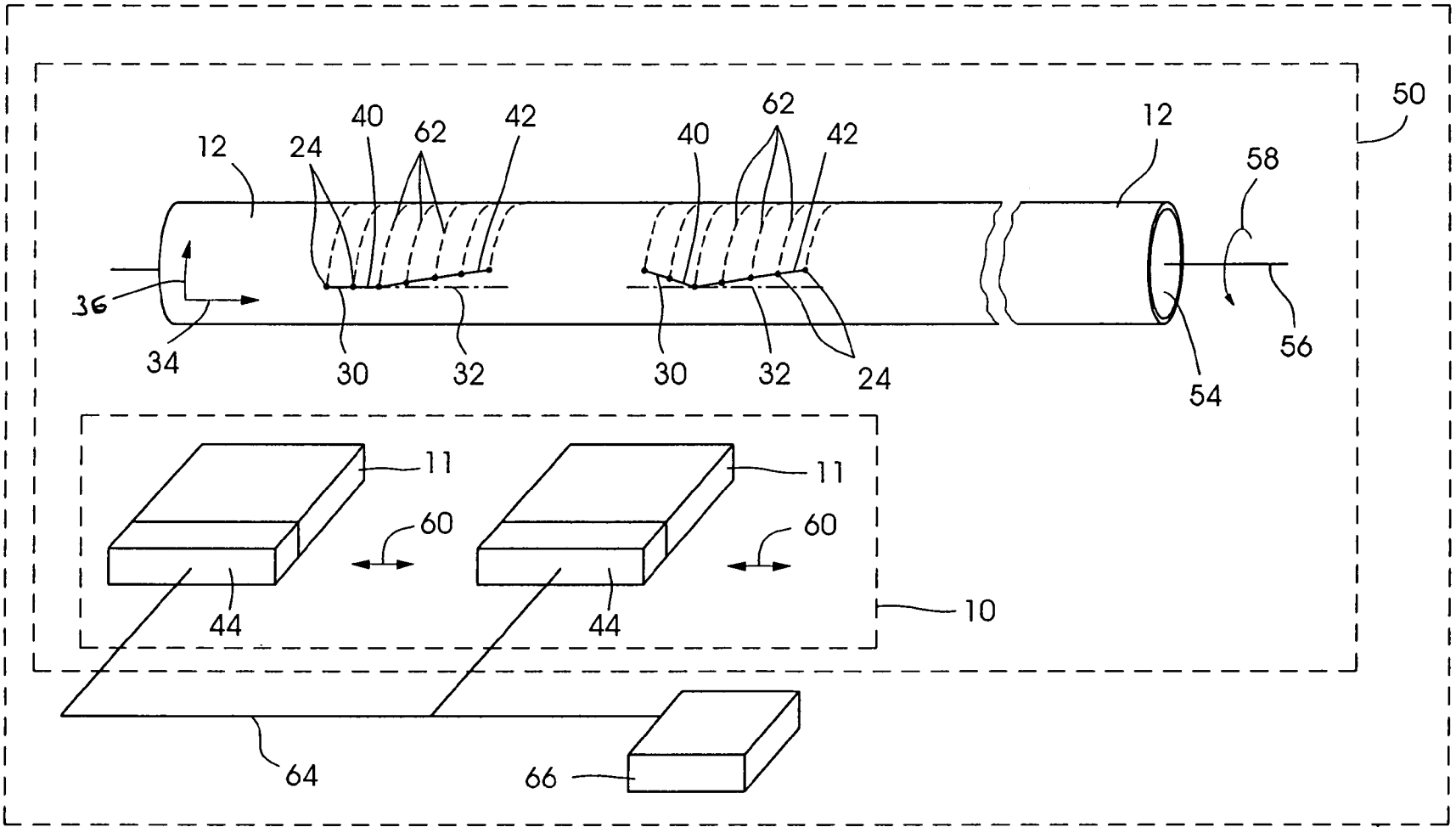
FIG. 2 a schematic representation of one specific embodiment of an imaging device according to the present invention having two imaging modules in one print unit of a printing press.

FIG. 2 is a schematic representation of one specific embodiment of an imaging device 10 according to the present invention having two imaging modules 11 in one print unit 50 of a printing press 52. A printing form 12 is accommodated on a printing-form cylinder 54, which is able to execute a rotary motion 58 about its axis of rotation 56. The light emitted by imaging modules 11 of imaging device 10 strikes in each instance along a spanning polyline 30 on the surface of printing form 12. In response to the co-action of rotary motion 58 of printing-form cylinder 54 in azimuthal (rotational) spanning direction 36 and translational motion 60 of imaging device 10 in axial spanning direction 34, image spots 24 traverse a helical path 62 on two-dimensional printing form, sweeping at least once over each spot on the printing surface of printing form 12. In this manner, an interleave imaging method is able to be realized in accordance with German Patent Application No. DE 100 31 915 A1 and U.S. Patent Application No. 2002/0005890 A1, respectively, which are incorporated herein. Imaging modules 11 have a data and control connection 64 to triggering unit 66. Not shown in greater detail here in FIG. 2 are, inter alia, the drives for the rotary and translational motion, which are mutually coordinated. For that reason, triggering unit 66 has a connection to the machine control.

In accordance with the present invention, two laser diode bars (see FIG. 1) are provided in each imaging module 11. It is generally possible to minimize a negative effect of deformations resulting from assembly; image spots 24 of one of the two laser diode bars lie in a straight line: Image spots 24 of first laser diode bar lie in a first straight line 40, and image spots 26 of second laser diode bar lie in a second straight line 42. When first and second lines 40, 42 do not already lie in a straight line 32, preferably in parallel to axial spanning direction 34, a time-delayed triggering of the individual laser diodes by control unit 44 is able to be carried out in the above-mentioned manner, with the result that, in response thereto, the printing dots set by image spots lie in a straight line 32 (projection) (see also German Patent Application No. DE 101 24 215 A1 and U.S. Patent Application No. 2003/0026176 A1, respectively, incorporated herein).

Figure 3:
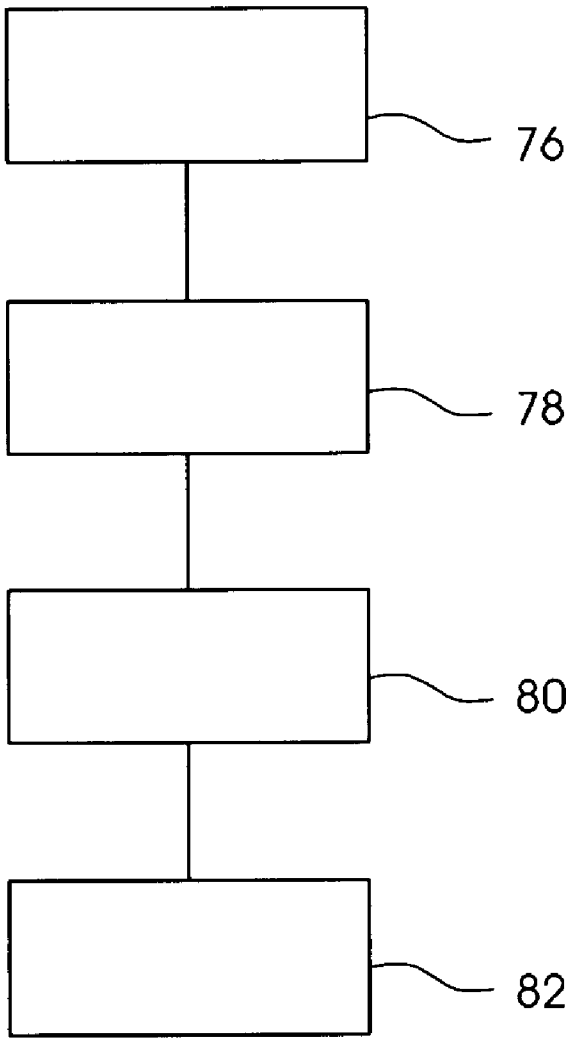
FIG. 3 a flow chart of one specific embodiment of the method according to the present invention.

In a flow chart, FIG. 3 relates to one specific embodiment of the method according to the present invention. A first laser diode bar 14 is first mounted 76 on a heat sink element 38. A first micro-optics is positioned 78 in the emission region of first laser diode bar. A second laser diode bar is then mounted 80 on heat sink element 38. A second micro-optics is positioned 82 in such a way in the emission region of the second laser diode bar, that the image spots of the laser diodes of the first and of the second laser diode bar lie at disjoint positions, along a spanning polyline, which is representable as a function of a variable of a spanning direction of the printing form. A line as defined herein can include a line which is substantially linear.

REFERENCE SYMBOL LIST

| | |
|---|---|
| 10 | imaging device |
| 12 | printing form |
| 14 | first laser diode bar |
| 16 | second laser diode bar |
| 18 | laser diodes |
| 20 | micro-optical array |
| 21 | first micro-optics |
| 22 | second micro-optics |
| 23 | macro-optical imaging optics |
| 24 | image spots |
| 26 | position of the image spots prior to adjustment |
| 28 | adjustment |
| 30 | spanning polyline |
| 32 | straight line |

-continued

REFERENCE SYMBOL LIST

| | |
|---|---|
| 34 | spanning direction (axial) |
| 36 | spanning direction (azimuthal) |
| 38 | heat sink element |
| 40 | first straight line |
| 42 | second straight line |
| 44 | control unit |
| 46 | sagittal micro-optical element |
| 48 | meridional micro-optical element |
| 50 | print unit |
| 52 | printing press |
| 54 | printing-form cylinder |
| 56 | axis of rotation |
| 58 | rotary motion |
| 60 | translational motion |
| 62 | path of the image spots |
| 64 | data and control connection |
| 66 | triggering unit |
| 68 | printing dot size |
| 70 | spatial interval of the image spots |
| 72 | pitch of the laser diodes |
| 74 | spatial interval of the laser diode bars |
| 76 | mounting of first laser diode bar |
| 78 | positioning of first micro-optics |
| 80 | mounting of second laser diode bar |
| 82 | positioning of second micro-optics |

What is claimed is:

1. An imaging device for a printing form comprising:

a first laser diode bar having first laser diodes disposed in a first line and having a first emission region;

a second laser diode bar having second laser diodes being disposed in a second line and having a second emission region;

a micro-optical array for generating aberration-corrected intermediate image spots of the laser diodes, the micro-optical array including a first micro-optics and a second micro-optics;

a single macro-optical imaging optics for generating image spots of the intermediate image spots of the first laser diodes of the first laser diode bar and of the second laser diodes of the second laser diode bar on the printing form, the first micro-optics being positioned in the first emission region and the second micro-optics being positioned in the second emission region so that image spots of the first laser diodes of the first laser diode bar and of the second laser diodes of the second laser diode bar lie at disjoint positions on the printing form along a spanning polyline, the spanning polyline being representable as a function of a variable of a spanning direction of the printing form;

each of the first and second laser diodes of the first laser diode bar and the second laser diode bar being individually controllable.

2. The imaging device as recited in claim 1 wherein the first line and the second line lie in a straight line.

3. The imaging device as recited in claim 1 wherein the first and the second laser diode bar are accommodated on one heat sink element.

4. The imaging device as recited in claim 1 wherein the spanning polyline is composed of sectionally straight lines.

5. The imaging device as recited in claim 1 wherein the spanning polyline is substantially a straight line.

6. The imaging device as recited in claim 5 wherein the spanning direction is the direction of the straight lines of the spanning polyline.

7. The imaging device as recited in claim 1 further comprising a control unit permitting time-delayed triggering of the first and second laser diodes.

8. The imaging device as recited in claim 1 wherein the first micro-optics and the second micro-optics each include two optical elements, one of the elements having a refractive action in the sagittal direction on light emitted by the associated laser diode bar, and the other one of the elements having a refractive action in the meridional direction on light emitted by an associated one of the first and second laser diode bars.

9. The imaging device as recited in claim 1 wherein a spatial interval between adjacent image spots on the printing form illuminated by either the first or the second laser diode bar, measured in units of a pitch distance of printing dots, is an integral multiple of the pitch distance of the printing dots, and is greater than one.

10. The imaging device as recited in claim 9 wherein the integral multiple is prime to the number of image spots.

11. The imaging device as recited in claim 10 wherein the integral multiple and the number of image spots are prime numbers other than one.

12. The imaging device as recited in claim 1 further comprising at least one further laser diode bar having further laser diodes and a further emission region and further comprising a further micro-optics positioned in the further emission region so that the further image spots of the laser diodes also lie at disjoint positions on the printing form, along a continuation of the spanning polyline, the spanning polyline, including the continuation, being representable as a function of the variable of the spanning direction of the printing form.

13. A printing-form imagesetter comprising at least one imaging device as recited in claim 1.

14. A print unit comprising at least one imaging device as recited in claim 1.

15. A printing press comprising at least one print unit as recited in claim 14.

16. A method for arranging optical components in an imaging device for a printing form, comprising the steps of:

mounting a first laser diode bar having first laser diodes having a first emission region on a heat sink element;

positioning a first micro-optics in the first emission region;

mounting a second laser diode bar having second laser diodes having a second emission region on the heat sink element;

positioning a second micro-optics in the second emission region so that image spots of the first laser diodes and of the second laser diodes generated by a single macrooptics out of intermediate image spots lie at disjoint positions, substantially along a spanning polyline, the spanning polyline being representable as a function of a variable of a spanning direction of the printing form;

each of the laser diodes of the first laser diode bar and the second laser diode bar being individually controllable.

17. The method as recited in claim 16 wherein the first and second laser diode bars are mounted side-by-side so that the first laser diodes and the second laser diodes lie in one line.

18. The method as recited in claim 17 further comprising iterating the compensating step for the second laser diode bar for a plurality of further laser diode bars and further micro-optics.

19. The method as recited in claim 16 further comprising compensating for a positional tolerance of the second laser diode bar by adjusting the second micro-optics.

* * * * *